US005176361A

United States Patent [19]

Ayala, III

[11] Patent Number: 5,176,361

[45] Date of Patent: Jan. 5, 1993

[54] VEHICLE WHEEL GRIPPER

[76] Inventor: Nick A. Ayala, III, 1524 E. Carson Rd., Phoenix, Ariz. 85040

[21] Appl. No.: 674,094

[22] Filed: Mar. 25, 1991

[51] Int. Cl.[5] ..... E02C 3/00

[52] U.S. Cl. ..... 254/88

[58] Field of Search ..... 254/88, DIG. 1, 126; 248/352, 174

[56] References Cited

U.S. PATENT DOCUMENTS

| | | | |
|---|---|---|---|
| 2,297,556 | 9/1942 | Herman | 254/DIG. 1 |
| 3,178,156 | 4/1965 | Rigers | 254/88 |
| 3,326,525 | 6/1967 | Kauppi | 254/88 |
| 3,847,376 | 11/1974 | Binding | 254/88 |
| 3,870,277 | 3/1975 | West | 259/88 |
| 3,917,227 | 11/1975 | West | 254/88 |

FOREIGN PATENT DOCUMENTS

| | | | |
|---|---|---|---|
| 2019448 | 11/1971 | Fed. Rep. of Germany | 254/88 |

*Primary Examiner*—Robert C. Watson

*Attorney, Agent, or Firm*—Harry M. Weiss

[57] ABSTRACT

A vehicle wheel gripper assembly and method for use in extracting a vehicle from a slippery and unlevel hole or rut in a ground portion having ice or snow or loose sand on loose gravel or the like. The assembly includes a ramp section, a flat section, and an interconnecting hinge means. Each section has friction grips on the top thereof and ground connectors on the bottom thereof. The ground connectors become continuously imbedded and connected to the ground by horizontal friction forces applied by the wheel on the friction grips.

3 Claims, 2 Drawing Sheets

VEHICLE WHEEL GRIPPER

The invention generally relates to a vehicle wheel gripper and method, and in particular the invention relates to a vehicle wheel gripper and method having a bottom ground connection and having top tire friction grips.

BACKGROUND OF THE INVENTION

One prior art vehicle wheel support is described in U.S. Pat. No. 3,638,910 issued Feb. 1, 1972. Related patents include:

U.S. Pat. Nos. 884,847 issued Apr. 14, 1908
U.S. Pat. No. 2,141,529 issued Dec. 27, 1938
U.S. Pat. No. 2,266,543 issued Dec. 16, 1941
U.S. Pat. No. 2,436,467 issued Feb. 24, 1948
U.S. Pat. No. 2,607,937 issued Aug. 26, 1952
U.S. Pat. No. 2,924,427 issued Feb. 09, 1960
U.S. Pat. No. 3,517,791 issued June 30, 1970
U.S. Pat. No. 3,984,891 issued Oct. 12, 1976.

The related patents concern either truck ramps for unlocking objects from a truck bed, or wheel ramps for raising one wheel of an automobile to be repaired.

The prior art vehicle wheel support, which is described in U.S. Pat. Nos. 3,638,910 and vehicle is used to support one wheel of a car to be repaired, includes a raised flat section and a rigidly connected ramp section which has top tire friction grips.

One problem with the prior art vehicle wheel support is that it is not suitable as a wheel gripper in a muddy dirt hole or loose gravel rut for extracting the vehicle therefrom.

SUMMARY OF THE INVENTION

One object of the present invention is to provide a means and method of extracting a vehicle from a hole or rut having an non-level ground surface profile.

Another object is to provide a means and method of extracting a vehicle from a slippery ground portion which is mainly composed of ice, snow, loose sand or loose gravel.

The foregoing and other objects, features and advantages will be apparent from the following description of the preferred embodiment of the invention as illustrated in the accompanying drawings.

BRIEF DESCRIPTION OF PREFERRED EMBODIMENT

According to the present invention, a vehicle wheel gripper is provided. This wheel gripper comprises a ramp section having top wheel gripping elements and bottom ground connector units and comprises a raised section having top wheel gripping elements and bottom ground connector units and comprises a hinge connection therebetween for adjusting a vertical angle of the ramp section relative to the raised section to suit a ground surface profile.

By using the hinge connection, the ramp section and raised section can automatically adjust to the ground surface profile of the hole or rut from which the vehicle is to be extracted. Also, by using the bottom ground connector units, the ramp section and raised section become embedded into the ground to prevent slippage of the wheel gripper relative to the ground.

In addition, according to the present invention, a method of extracting a vehicle from a hole is provided. This method includes the steps of, forming a ramp assembly having adjustable sections with top tire grippers and bottom ground connectors; placing the ramp assembly in front of the vehicle drive wheel with the sections adjusted to the ground surface profile in front of the drive wheel; and applying torque to the drive wheel to force the wheel over the tire grippers while embedding the ground connector in the ground under the section.

DESCRIPTION OF THE PREFERRED EMBODIMENT

Figure 1:
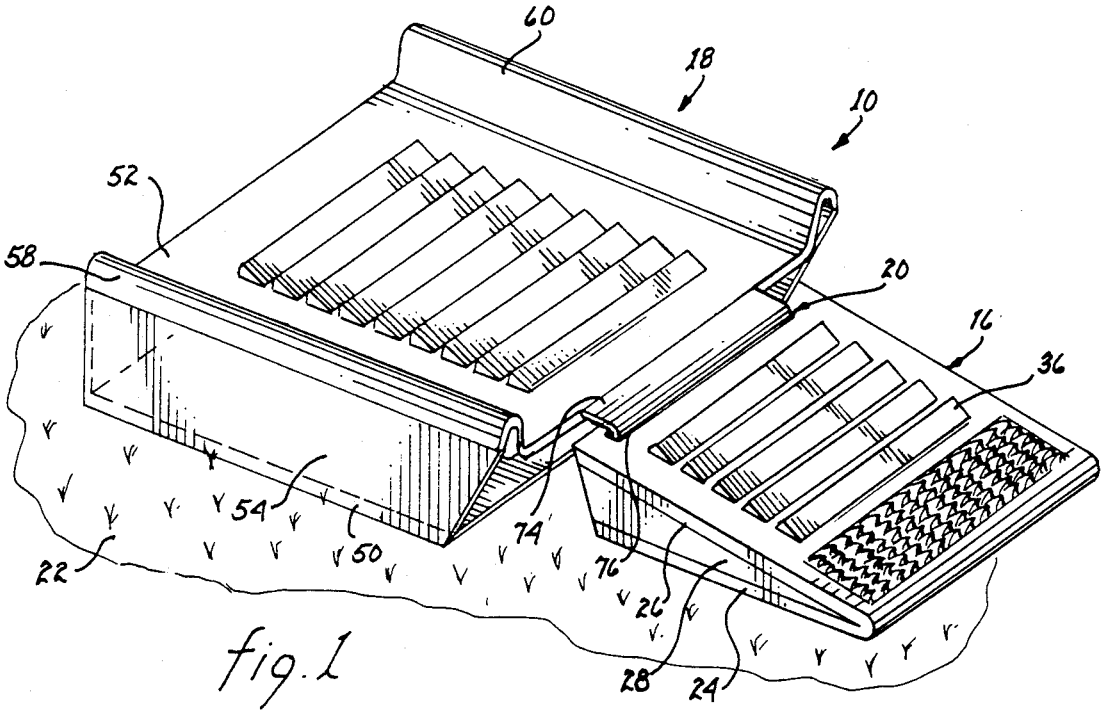
FIG. 1 is a perspective view of the vehicle wheel gripper according to the present invention.

As shown in FIG. 1 through 7, a vehicle wheel apparatus or wheel gripper or assembly 10 is provided. Assembly 10 is used under a vehicle drive wheel 12 and tire 14 (see FIG. 4) for extracting the vehicle from a hole or rut. Assembly 10 has a sloping right section or ramp section 16, and has a raised flat left section 18, and has a hinge connection 20 interconnecting section 16 and 18 (see FIG. 1). Assembly 10 is supported on a low-friction grade or ground portion 22, which is composed of muddy soil, wet soil, loose gravel, ice, snow, loose dirt or the like. Ground 22 is shown as a flat surface for ease of illustration.

Figure 2:
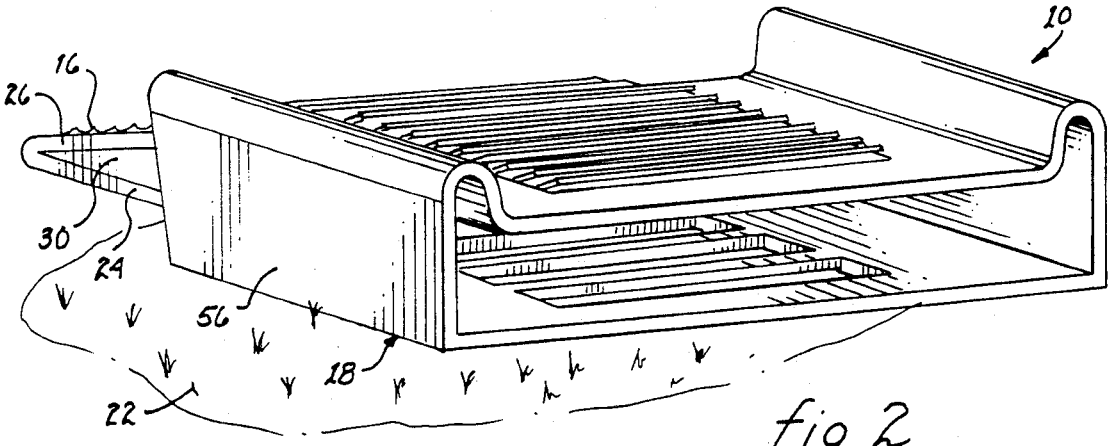
FIG. 2 is another perspective view of the vehicle wheel gripper of FIG. 1.
Figure 5:
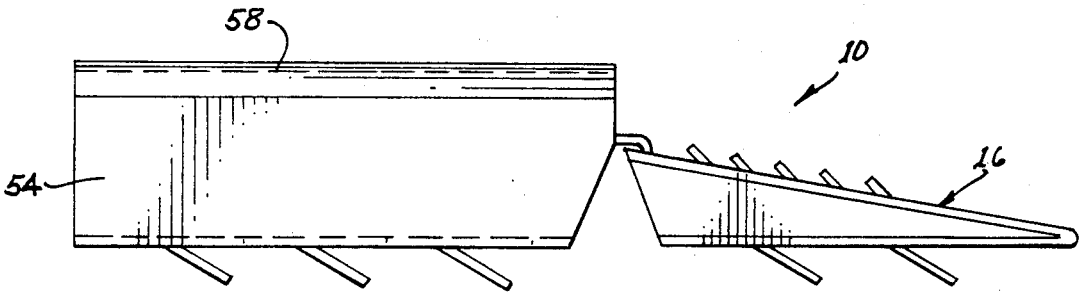
FIG. 5 is an elevation view of the vehicle wheel gripper as taken along the line 5—5 of FIG. 3.
Figure 3:
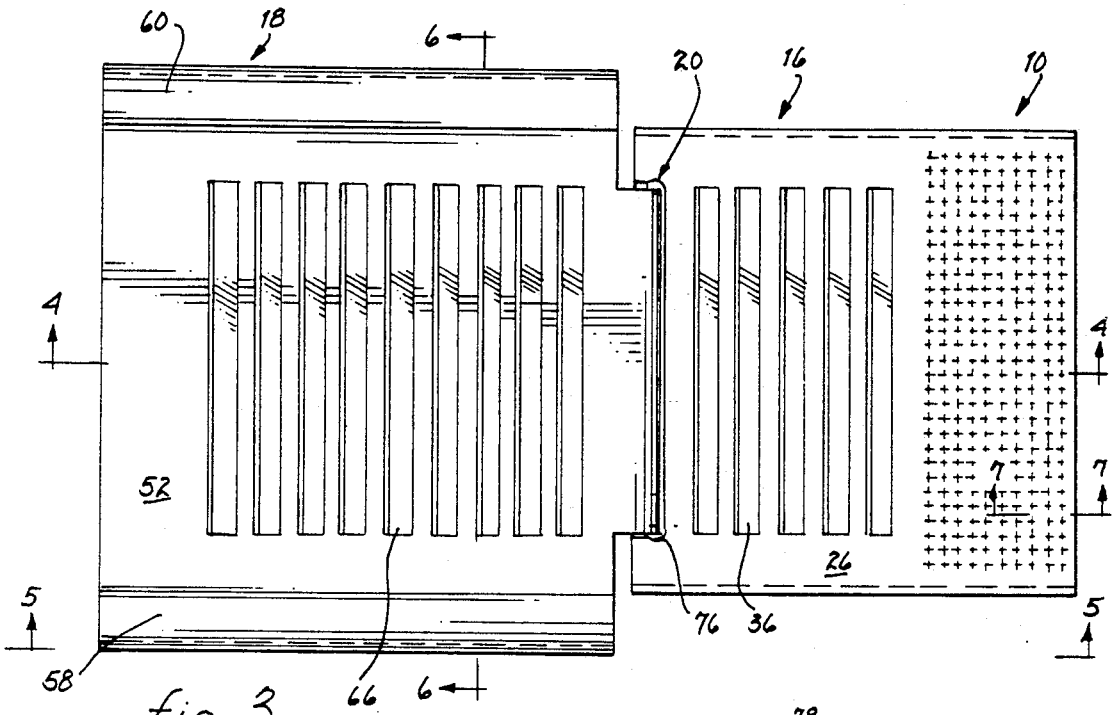
FIG. 3 is a plan view of the vehicle wheel gripper of FIG. 1.

Sloping section 16 has a bottom plate 24, a sloping top plate 26, a front plate 28, and a rear plate 30 (see FIG. 2). The plates 24, 26, 28, 30 are steel plates. Top plate 26 is supported by plates 28, 30 which are supported by plate 24.

Figure 4:
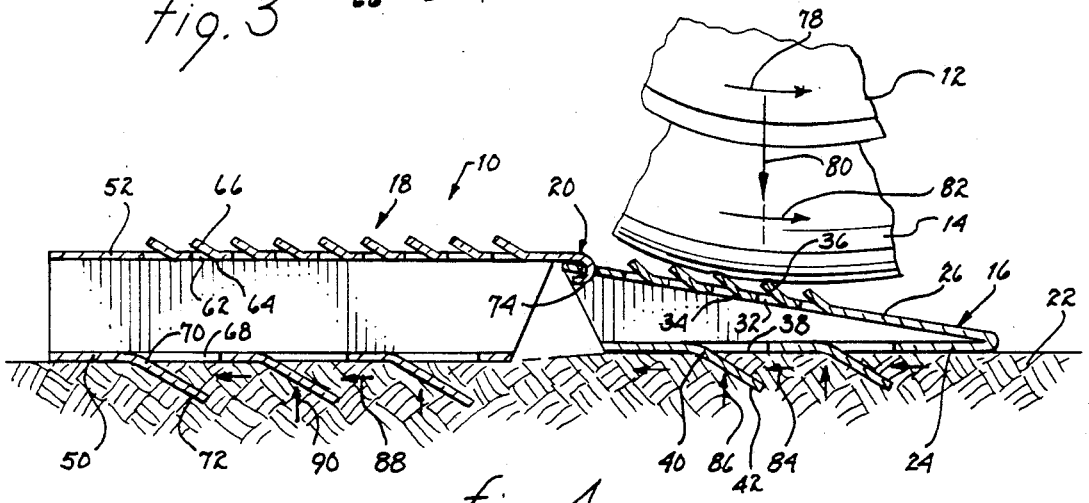
FIG. 4 is a section view of the vehicle wheel gripper as taken along the line 4—4 of FIG. 3.
Figure 6:
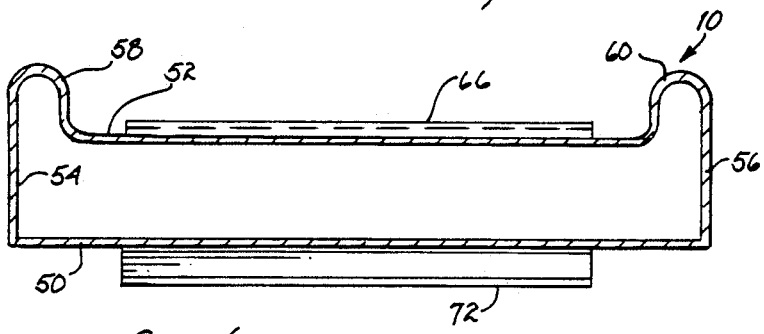
FIG. 6 is a section view of the vehicle wheel gripper as taken along the line 6—6 of FIG. 3.

As shown in FIG. 4, sloping top plate 26 has a plurality of elongate holes 32. Each of the holes 32 has an elongate edge portion 34. Each edge portion 34 connects to one of a plurality of elongate cantilevered plate portions or friction grips 36. Each friction grip 36 is fixedly connected to a portion of its edge portion 34 and is integral therewith.

Bottom plate 24 has a plurality of elongate bottom holes 38 (see FIG. 4). Each of the holes 38 has an elongate edge portion 40. Each edge portion 40 connects to one of a plurality of elongate cantilevered plate portions or shear plates or ground connectors 42. Top plate 26 is supported by side walls 28 (see FIG. 1) and 30 (see FIG. 2).

Figure 7:
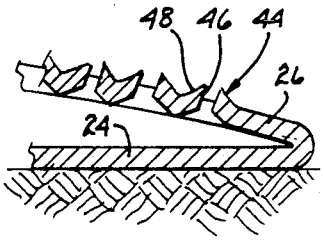
FIG. 7 is a detail section view as taken along the line 7—7 of FIG. 3.

As shown in FIG. 7, top plate 26 also has a plurality of raised portions or friction grips 44, each of which has a center punched aperture 46, that is surrounded by a plurality of punched-out edge portions tines 48. Grips 44 are disposed on the lower or right end of the top plate 26.

As shown in FIG. 1, left plate section 18 has a bottom plate or wall 50 a flat top wall 52, a front wall 54, and a rear wall 56 (see FIG. 2). Front and rear walls 54, 56 have respective arcuate curb portions 58, 60 forming a curb on two sides of top wall 52. Walls 54, 56 support top wall 52 and wall 50.

As shown in FIG. 4, top wall 52 has a plurality of elongate apertures 62. Each aperture 62 has an elongate edge portion 64. Each edge portion 64 has an elongate cantilevered wall portion or friction grip 66.

Bottom wall 50 (see FIG. 4) has a plurality of elongate bottom apertures 68. Each aperture 68 has an elongate edge portion 70. Each edge portion 70 has an elongate cantilevered wall portion or shear plate or ground connector 72.

As shown in FIG. 1, hinge 20 includes an elongate edge hook 74 which is fixedly connected to top wall 52. Hinge 20 also includes an elongate edge slop 76 which receives hook 74 and which is disposed in sloping top plate 26. Sloping section 16 can swivel about hinge 20 relative to flat section 18; and also can minimize bending stresses in assembly 10.

As shown in FIG. 4, assembly 10 supports drive wheel 12 and its tire 14. Wheel 12 applies a torque 78 and applies a weight or downward force 80, which causes a friction force 82 on assembly 10. Downward force 80 is transmitted through assembly 10 to ground 22. Friction force 82 is transmitted through assembly 10 to ground 22. Ground 22 applies horizontal reaction forces 84 on section 16. Ground 22 also applies vertical reaction forces 86 on section 16. Forces 84, 86 vary in magnitude, depending on the location of wheel 12 relative to sections 16, 18. Ground 22 also applies vertical reaction forces 88 on section 18. Ground 22 also applies horizontal reaction forces 90 on section 18. Hinge 20 reduces the bending stresses in assembly 10 which are caused by reactions 84, 86, 88, 90. Hinge 20 permits a change of angle of up to about 45 degrees of section 16 relative to section 18. Hinge 20 permits sections 16, 18 to conform to the profile of the ground portion under assembly 10.

As shown in FIG. 1, in this embodiment, the sloping or ramp section 16 measures 10.0 inches wide, normal to walls 28, 30 (see FIG. 2) and 8.0 inches long and has about a 10 degree ramp angle. The raised portions or protrusions 44 (see FIG. 7) cover an area with a length, parallel to front and rear walls 28 (see FIG. 1) 30 (see FIG. 2) of about 2.75 inches, and have a spacing of about 0.25 inches. The tire grips 36 (see FIG. 1 & 3) are about 0.125 inches thick by 0.50 inches, in a direction parallel, to walls 28, 30, by 8.0 inches in the direction width direction. Protrusions 44 (see FIG. 7) and grips 3 (see FIGS. 1, 3, 4) help wheel 12 (see FIG. 4) to continue on its path, up the incline of ramp section 16, until wheel 12 reaches section 18 (see FIG. 4). Section 18 (see FIG. 1) is about 8.75 inches length wise, parallel to walls 54, 56 (see FIG. 2) and is about 12.0 inches, normal to walls 54, 56. Tire grips 66 (see FIG. 3 and 4), like grips 36 measure 0.125 inches in thickness, by about 0.50 inches, parallel to walls 54, 56 and about 8.0 inches, parallel to walls 54 (see FIG. 1) 56 (see FIG. 2) and about 8.0 inches in a direction normal to walls 54, 56. Bottom connectors 42 (see FIG. 4) each measure about 0.125 inches in thickness, by about 1.00 inches parallel to walls 28, 30, by about 8.0 inches normal to walls 28, 30. Bottom connectors 72 (see FIG. 4) are the same size as bottom connectors 42. Grips 36, 66 (FIGS. 4 & 3) are disposed at an angle of about 30 degrees to the adjacent tire contact surface. Connectors 42, 72 (see FIG. 4) are disposed at an angle of about 30 degrees to their respective adjacent surface of plate 24 and wall 50. Grips 36, 66 (see FIG. 4) point away from the direction of friction force 82. Connectors 42, 72 point in the same direction as the direction of friction force 82.

The method of extracting a vehicle from a slippery, unlevel ground portion 22 (see FIG. 4) includes the steps of, forming apparatus 10, which has adjustable sections 16, 18 for supporting a vehicle drive wheel 12 and tire 14; forming top tire grippers 36, 66 on respective sections 16, 18 for gripping the tire 14 as it passes thereover; forming ground connectors 42, 72 on respective sections 16, 18 for connecting sections 16, 18 to ground 22 as tire 14 passes thereover; placing assembly 10 in front of tire 14 aligned therewith; and applying torque 78 to drive wheel 12 and tire 14 to force tire 14 over tire grippers 36, 66 while ground connectors 42, 72 become angularly imbedded in ground 22 under sections 16, 18.

The advantages of assembly 10 are indicated hereafter.

(A) Assembly 10 provides a means and method for extracting a vehicle from a slippery ground portion 22 which contains material such as ice, snow, loose sand, loose gravel, or the like.

(B) Assembly 10 provides a means and method for extracting a vehicle from a hole or rut which has an unlevel ground surface profile.

C) Assembly 10 can be stored in an automobile travel, etc. in a folded or disassembled condition for ease of storage and ready use.

While the invention has been described in its preferred embodiment, it is to be understood that the words which have been used are words of description rather than limitation and that changes may be made within the purview of the appended claims without departing from the true scope and spirit of the invention in its broader aspects. For example, two assemblies 10 can be used in alignment, back to back, in front of the tire 14. As another example, three assemblies 10 can be used, two of which are aligned back to back in front of tire 10, and one of which is aligned behind the tire for rocking the vehicle.

I claim:

1. A vehicle tire gripper apparatus for permitting a tire to be extracted from a soft terrain area comprising:

a first inclined section having top and bottom plates;

a second completely flat section having top and bottom walls;

a separable hinge connection interconnecting the first inclined section to the second flat section;

said top plate of said first inclined section having a plurality of friction grips with each of said grips having the configuration of an elongate hole located beneath a cantilevered portion extending towards said second flat section;

said bottom plate of said first inclined section having a plurality of ground connectors with each of said connectors having the configuration of an elongate hole located above a cantilevered portion extending in an opposite direction to the cantilevered portion of said top plate;

the top wall of said second flat section has a plurality of friction grips with each of said grips having an elongate hole located beneath a cantilevered portion extending away from said first inclined section;

the bottom wall of said second flat section has a plurality of ground connectors with each of said connectors having an elongate hole located above a cantilevered portion extending in an opposite direction to the cantilevered portion of said top wall.

2. The apparatus of claim 1, wherein each friction grip cantilevered portion projects forwardly in a direction of travel f a vehicle wheel; and each one of said ground connectors cantilevered portion projects rearwardly in a direction opposite to the direction of travel of the vehicle wheel.

3. The apparatus of claim 1, wherein the top plate of the first inclined section has a plurality of raised portions at a lower end thereof; and each said raised portion has an aperture with surrounding punched-out edge portions.

* * * * *